US010814353B2

(12) United States Patent
Kinuta

(10) Patent No.: US 10,814,353 B2
(45) Date of Patent: Oct. 27, 2020

(54) SIEVE

(71) Applicant: OPTNICS PRECISION CO., LTD., Ashikaga-shi, Tochigi (JP)

(72) Inventor: Seichin Kinuta, Ashikaga (JP)

(73) Assignee: OPTNICS PRECISION CO., LTD., Ashikaga-shi, Tochigi (JP)

( * ) Notice: Subject to any disclaimer, the term of this patent is extended or adjusted under 35 U.S.C. 154(b) by 76 days.

(21) Appl. No.: 16/304,696

(22) PCT Filed: Feb. 20, 2018

(86) PCT No.: PCT/JP2018/006008
§ 371 (c)(1),
(2) Date: Nov. 27, 2018

(87) PCT Pub. No.: WO2018/159388
PCT Pub. Date: Sep. 7, 2018

(65) Prior Publication Data

US 2019/0168260 A1 Jun. 6, 2019

(30) Foreign Application Priority Data

Mar. 1, 2017 (JP) ..... 2017-038268

(51) Int. Cl.
*B07B 1/46* (2006.01)

(52) U.S. Cl.
CPC ..... *B07B 1/4609* (2013.01); *B07B 1/46* (2013.01); *B07B 1/469* (2013.01)

(58) Field of Classification Search
CPC ..... B07B 1/4609; B07B 1/46; B07B 1/469; B07B 1/4645
See application file for complete search history.

(56) References Cited

U.S. PATENT DOCUMENTS 989,976 A * 4/1911 Hunnicutt ..... B07B 1/46 209/253
1,009,069 A * 11/1911 Hunnicutt ..... B07B 1/469 209/397

(Continued)

FOREIGN PATENT DOCUMENTS

DE 2634934 A1 11/1977
JP 2011-67762 A 4/2011

(Continued)

OTHER PUBLICATIONS

Office Action dated Jun. 12, 2020, issued by the KIPO in corresponding Korean Patent Application No. 10-2018-7035402.

*Primary Examiner* — Patrick H Mackey
(74) *Attorney, Agent, or Firm* — Solaris Intellectual Property Group, PLLC

(57) ABSTRACT

In a sieve, unit blocks are arrayed along an up-down direction and a left-right direction. Each unit block includes elongated holes and short holes that are shorter than the elongated holes. In each of the unit blocks, the elongated holes include a first elongated hole extending along a first length direction and a second elongated hole extending along a second length direction intersecting an extension line running along the first length direction. Plural of the short holes are arranged in each of the unit blocks so as to be arranged between long edges of adjacent elongated holes of the elongated holes.

4 Claims, 4 Drawing Sheets

(56) References Cited

U.S. PATENT DOCUMENTS

| | | | | | |
|---|---|---|---|---|---|
| 1,026,265 | A * | 5/1912 | Hunnicutt | B07B 1/469 | 209/397 |
| 4,505,434 | A * | 3/1985 | Martenas | A01F 29/06 | 241/101.76 |
| 4,640,364 | A * | 2/1987 | Theurer | E01B 27/105 | 104/7.1 |
| 8,256,623 | B2 * | 9/2012 | Olsen | B07B 1/46 | 209/392 |
| 8,267,255 | B2 * | 9/2012 | Kinuta | B07B 1/4618 | 209/397 |

FOREIGN PATENT DOCUMENTS

| | | | | |
|---|---|---|---|---|
| JP | 5414438 | B2 | 2/2014 | |
| JP | 5607331 | B2 | 10/2014 | |
| WO | 98/30309 | A1 | 7/1998 | |
| WO | WO-9830309 | A1 * | 7/1998 | B01D 29/111 |
| WO | 2008/141373 | A1 | 11/2008 | |

* cited by examiner

SIEVE

TECHNICAL FIELD

The present disclosure relates to a sieve.

BACKGROUND ART

The speed of an operation to classify spherical particles efficiently is known to be an important technological factor directly affecting productivity in various industries. In particular, the efficient sieving of near perfectly spherical particles such as solder balls is an issue highly pertinent to cost, quality, and so on.

Hitherto, holes in sieves configuring sieving devices have been predominantly circular or square in shape. Moreover, the holes are predominantly arranged at positions corresponding to a grid, or are occasionally arranged in a triangular shape so as to come to a peak. In either case, the holes are arranged uniformly in what is referred to as a "sieve mesh".

In cases in which such a sieve mesh is employed, the sieve is driven in radial directions or the like in addition to an up-down direction and a left-right direction, and is continually vibrated during the sieving operation. The purpose of such vibration is to cause particles to drop through the holes in the sieve as quickly as possible after coming into contact with the holes.

However, an issue exists whereby up and down vibration causes the particles to dance around the holes in the sieve, such that the particles are unable to pass through the holes smoothly. Furthermore, during what is referred to as two-dimensional planar vibration to the front, rear, left, and right, an issue exists whereby particles have many opportunities to pass over the top of the holes depending on the speed and acceleration of the vibration, and so sieving cannot be performed efficiently. Moreover, in cases in which, as hitherto, the holes in the sieve are near to being square or perfectly circular in shape, namely surrounded by circular arcs i.e. arcs of the shortest holes, an issue arises in which particles become stuck as if they were lodged in depressions, thus blocking the holes.

As the mechanism by which particles pass through a hole, a vibrating particle approaches a hole wall, contacts the hole wall, is caught by an end portion of the hole wall, and then drops down. Namely, the longer the length of the wall of the hole through which the particle is attempting to pass, the greater the opportunity to contact a particle that is attempting to pass through, thereby enabling the particle to pass through more easily. Thus, sieve meshes hitherto have generally provided insufficient opportunity for particles relying on horizontal direction force to move over a planar mesh face to pass through the holes, resulting in inefficient sieving operation issues.

Note that when sieving particles in the order of 20 μm or smaller that exhibit a phenomenon in the particles dance up, applying positive pressure on the particle side while simultaneously applying negative pressure on the sieved side has been considered as a way of performing sieving operations more smoothly. However, a phenomenon also arises in which, once particles have been caught by the holes, the particles leave the holes less readily due to the force of the negative pressure, resulting in the issue that conventional sieve mesh holes are blocked easily, and are therefore inefficient.

In order to address these issues, for example, Patent Document 1 (Japanese Patent No. 5414438) proposes a metal plate sieve including elongated holes, with each elongated hole extending in one direction only. In this sieve, plural elongated holes are provided such that an extension line running along a length direction of one elongated hole intersects extension lines running along the length directions of elongated holes adjacent to the one elongated hole in the up-down and left-right directions. Moreover, elongated holes with their length in the left-right direction and elongated holes with their length in the up-down direction are provided alternately in both the up-down and left-right directions.

Moreover, Patent Document 2 (Japanese Patent No. 5607331) proposes a sieving mask employed to sort metal spheres according to sphere diameter, and including a sieve grid in which multiple patterned openings are regularly arrayed at a high density. In this sieving mask, the patterned opening area per unit surface area (opening coverage ratio) contributing to sorting processing is greater than in the conventional example disclosed in Patent Document 1.

SUMMARY OF INVENTION

Technical Problem

However, in the conventional example disclosed in Patent Document 2, there is a concern that long and thin portions (low strength portions) between long edges of adjacent elongated holes might deform due to the weight of the particles and so on, resulting in the width of the elongated holes being enlarged. If the width of the elongated holes is enlarged, particles of a size that should not normally pass through the holes are able to pass through the elongated holes, thereby reducing the classification precision.

Moreover, although the opportunities for particles to contact hole walls increase when employing elongated holes, classification by the elongated holes is controlled by two opposing long edges. Accordingly, a particle with a portion larger than the width of the elongated hole might pass through the elongated hole if this particle also has a portion smaller than the width of the elongated hole.

An object of the present disclosure is to improve the opening coverage ratio, strength, and classification precision of a sieve.

Solution to Problem

In a sieve according to a first aspect, unit blocks are arrayed along an up-down direction and a left-right direction. Each unit block includes elongated holes and short holes that are shorter than the elongated holes. In each of the unit blocks, the elongated holes include a first elongated hole extending along a first length direction and a second elongated hole extending along a second length direction intersecting an extension line running along the first length direction. Plural of the short holes are arranged in each of the unit blocks so as to be arranged between long edges of adjacent elongated holes of the elongated holes.

In this sieve, in each of the unit blocks, the elongated holes include the first elongated hole extending along the first length direction and the second elongated hole extending along the second length direction intersecting the first length direction. Thus, when classifying particles, the particles easily pass through the elongated holes when the sieve is vibrated in various vibration directions, increasing the classification speed. This enables the operation efficiency of sieving to be improved.

Moreover, plural of the short holes that are shorter than the elongated holes are arranged in each unit block. Accordingly, the opening coverage ratio of the sieve is higher than in configurations in which the short holes are not formed. Since the short holes are arranged between the long edges of adjacent elongated holes, the formation of long and thin portions (low strength portions) between the long edges is suppressed. This enables the strength to be increased compared to cases in which the long edges of the elongated holes are close to each other. The elongated holes are thereby not liable to enlarge during classification. Moreover, employing the short holes in combination improves the classification precision.

A second aspect is the sieve according to the first aspect, wherein the extension line running along the first length direction intersects a second length direction center point of the second elongated hole, and an extension line running along the second length direction intersects a first length direction center point of the first elongated hole.

Due to this configuration, the first elongated holes and the second elongated holes are alternately arranged, and the respective holes are uniformly arranged. This enables imbalance in the strength of the sieve to be suppressed.

A third aspect is the sieve according to the first aspect or the second aspect, wherein the short holes are arranged in one or more rows running parallel to the second length direction.

In this configuration, particles that could not be caught by the elongated holes are caught by the more numerous short holes, enabling a more efficient sieving operation to be achieved.

A fourth aspect is the sieve according to any one of the first aspect to the third aspect, wherein a plan view profile of the short holes is at least one of a circular shape, an elliptical shape, or a polygonal shape.

In this sieve, the particles can be classified due to the plan view profile of the short holes being at least one of a circular shape, an elliptical shape, or a polygonal shape.

Advantageous Effects of Invention

The present disclosure is capable of improving the opening coverage ratio, strength, and classification precision of a sieve.

DESCRIPTION OF EMBODIMENTS

Explanation follows regarding exemplary embodiments of the present invention, with reference to the drawings.

First Exemplary Embodiment

Figure 1:
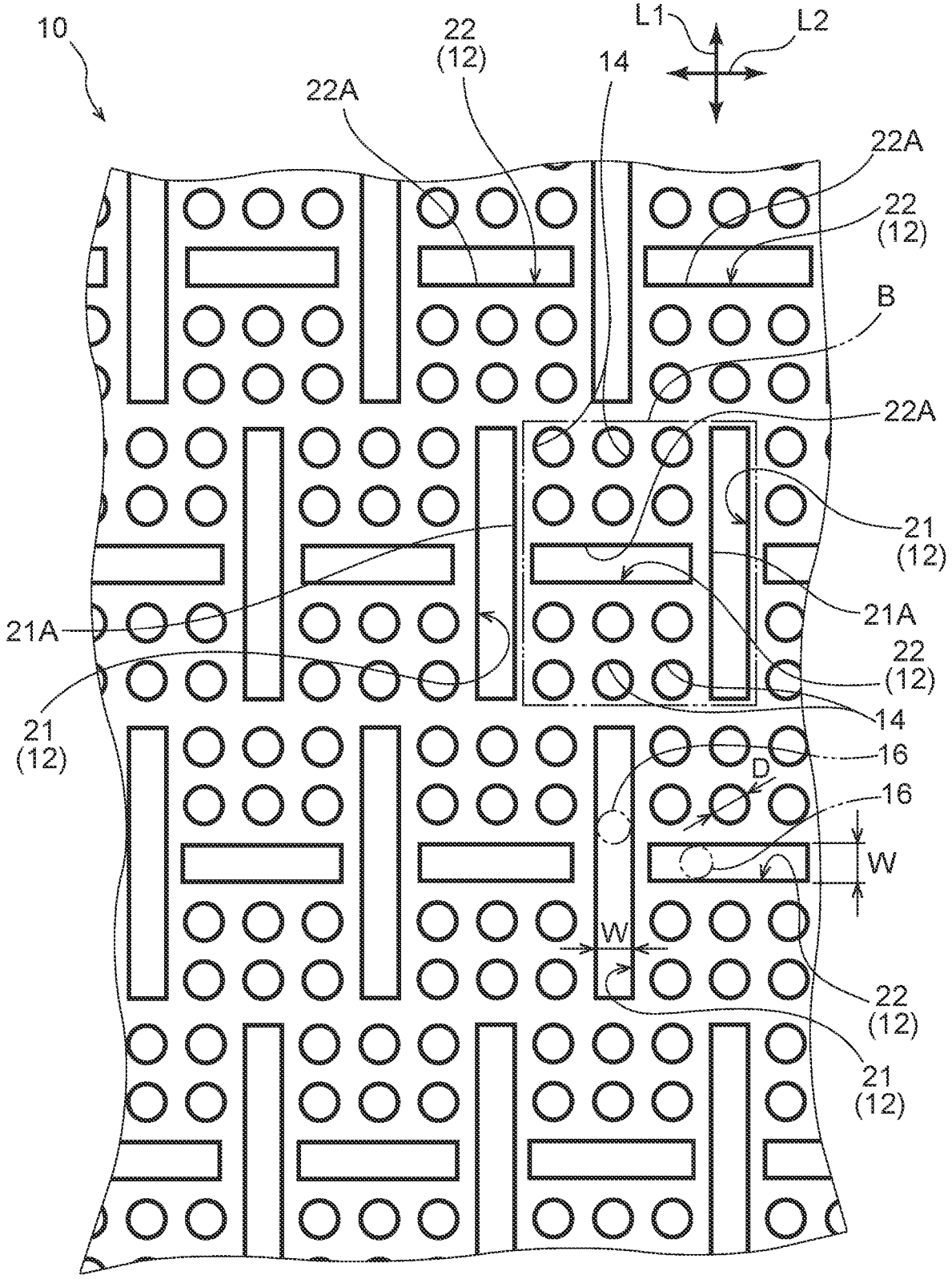
FIG. 1 is an enlarged plan view illustrating a sieve according to a first exemplary embodiment.

A sieve 10 according to an exemplary embodiment illustrated in FIG. 1 is a plate shaped member configured of a material such as nickel, a nickel alloy, or a resin. The sieve 10 is manufactured by electroforming, for example. Unit blocks B, each including elongated holes 12 and short holes 14 that are shorter than the elongated holes 12, are arrayed in up-down and left-right directions in the sieve 10. The elongated holes 12 and the short holes 14 are formed in order to classify spherical particles 16, such as solder balls. A width W of the elongated holes 12 and a diameter D of the short holes 14 are thereby set slightly larger than the diameter of the particles 16 so as to allow the particles 16 for classification to pass through. The length of the elongated holes 12 is set larger than the diameter of the particles 16 for classification.

In each unit block B, the elongated holes 12 include a first elongated hole 21 extending along a first length direction L1, and a second elongated hole 22 extending along a second length direction L2 that intersects an extension line running along the first length direction L1. The length of the first elongated hole 21 may be the same as, or may be different from, the length of the second elongated hole 22. The first elongated hole 21 and the second elongated hole 22 are both rectangular through-holes, for example. Note that the shapes of the first elongated hole 21 and the second elongated hole 22 may be elliptical shapes, parallelogram shapes, trapezoidal shapes, or the like. The shapes of the first elongated hole 21 and the second elongated hole 22 may include curving arc shapes, or bent V shapes.

The first elongated holes 21 and the second elongated holes 22 are arranged alternately to each other in the up-down and left-right directions in the unit blocks B. The extension line running along the first length direction L1 of a first elongated hole 21 thereby intersects second length direction L2 center points of the second elongated holes 22. Moreover, the extension line running along the second length direction L2 intersects first length direction L1 center points of the first elongated holes 21. Namely, a length direction extension line of each elongated hole 12 is orthogonal to another, adjacent elongated hole 12 at a length direction center point of the other elongated hole 12.

Plural short holes 14 are arranged between long edges of adjacent elongated holes 12, specifically, between long edges 21A of the first elongated holes 21 and between long edges 22A of the second elongated holes 22. For example, each short hole 14 has a circular plan view profile. At least one row of the short holes 14 is arranged parallel to the second length direction L2. In the illustrated example, two rows of the short holes 14 are arranged on either width direction (first length direction L1) side of each second elongated hole 22. Three short holes 14 are arranged in each row.

Thus, for example, one first elongated hole 21, one second elongated hole 22, and twelve short holes 14 are arranged in each unit block B.

Note that, for example, nickel plating may be formed on the surface of the sieve 10 to a thickness of 10 μm by composite electrodeposition of 0.1 μm to 2 μm fluorocarbon particles. This is in order to improve the wear resistance of the sieve 10, greatly extending the life of the sieve 10.

Operation

Explanation follows regarding operation of the present exemplary embodiment configured as described above. In the sieve 10 according to the present exemplary embodiment as illustrated in FIG. 1, the elongated holes 12 in each unit block B include the first elongated hole 21 extending along the first length direction L1 and the second elongated hole 22 extending along the second length direction L2 that intersects the first length direction L1. Thus, when classifying particles 16, the particles 16 easily pass through the elongated holes 12 when the sieve 10 is vibrated in various vibration directions, and the classification speed is increased. This enables the operation efficiency of sieving to be improved.

Moreover, plural of the short holes 14, which are shorter than the elongated holes 12, are arranged in each unit block B, such that the opening coverage ratio of the sieve 10 is higher than in configurations in which the short holes 14 are not formed. Classification is performed by the short holes 14 as well as the elongated holes 12, thereby enabling the operation efficiency of sieving to be further improved.

Furthermore, the short holes 14 are respectively arranged between the long edges of adjacent elongated holes 12, specifically, between the long edges 21A of the first elongated holes 21 and between the long edges 22A of the second elongated holes 22. This suppresses the formation of long and thin portions (low strength portions) between the long edges 21A and between the long edges 22A. This enables the strength to be increased compared to cases in which the long edges 21A of the first elongated holes 21 are arranged close to each other, and the long edges 22A of the second elongated holes 22 are arranged close to each other. The elongated holes 12 are thereby not liable to enlarge during classification. Moreover, employing the short holes 14 in combination suppresses non-spherical particles from passing through the sieve 10, thereby improving classification precision.

In the present exemplary embodiment, the extension lines running in the first length direction L1 intersect the second length direction L2 center points of the corresponding second elongated holes 22. Moreover, the extension lines running in the second length direction L2 intersect the first length direction L1 center points of the corresponding first elongated holes 21. Thus, the first elongated holes 21 and the second elongated holes 22 are alternately arranged, and the respective holes are uniformly arranged. This enables imbalance in the strength of the sieve 10 to be suppressed.

Furthermore, in the present exemplary embodiment, one or more rows of the circular short holes 14 are arranged parallel to the second length direction L2. Thus, particles 16 that could not be caught by the elongated holes 12 are caught by the more numerous short holes 14, enabling the particles 16 to be classified, and a more efficient sieving operation to be achieved.

Thus, the present exemplary embodiment enables the opening coverage ratio, strength, and classification precision of the sieve 10 to be improved.

Second Exemplary Embodiment

Figure 2:
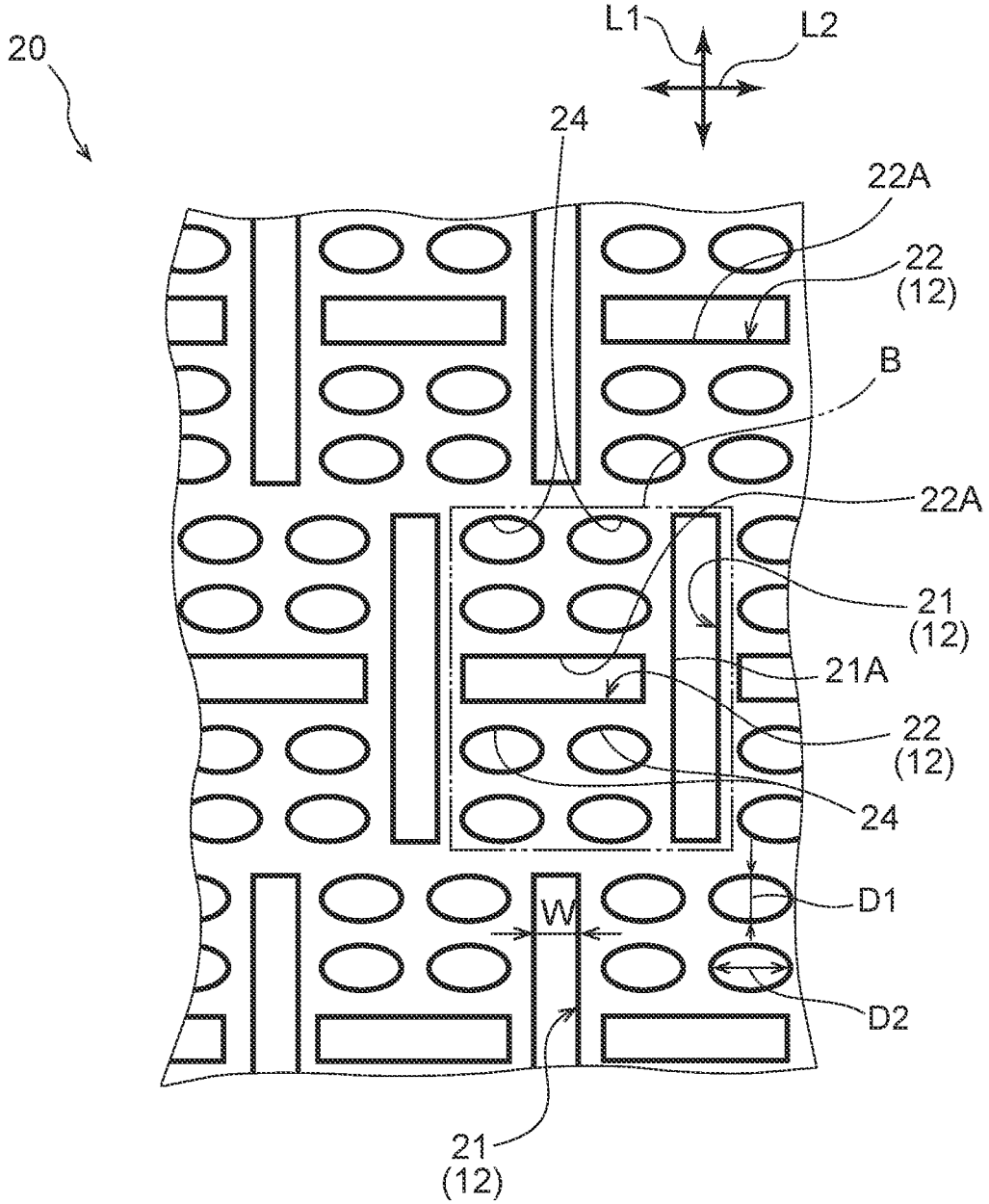
FIG. 2 is an enlarged plan view illustrating a sieve according to a second exemplary embodiment.

In a sieve 20 according to an exemplary embodiment illustrated in FIG. 2, for example, one first elongated hole 21, one second elongated hole 22, and eight short holes 24 are arranged in each unit block B. Each short hole 24 has an elliptical plan view profile. For example, two rows of short holes 24 are arranged on either width direction (first length direction L1) side of each second elongated hole 22. Two of the short holes 24 are arranged in each row. A minor axis D1 of the short holes 24 and a width W of the first elongated holes 21 are set slightly larger than the diameter of the particles 16 so as to allow the particles 16 for classification to pass through. A major axis D2 of the short holes 24 is parallel to the second length direction L2.

Other portions are similar to those in the first exemplary embodiment, and so the same reference numerals are appended to these portions in the drawings, and explanation thereof is omitted.

Third Exemplary Embodiment

Figure 3:
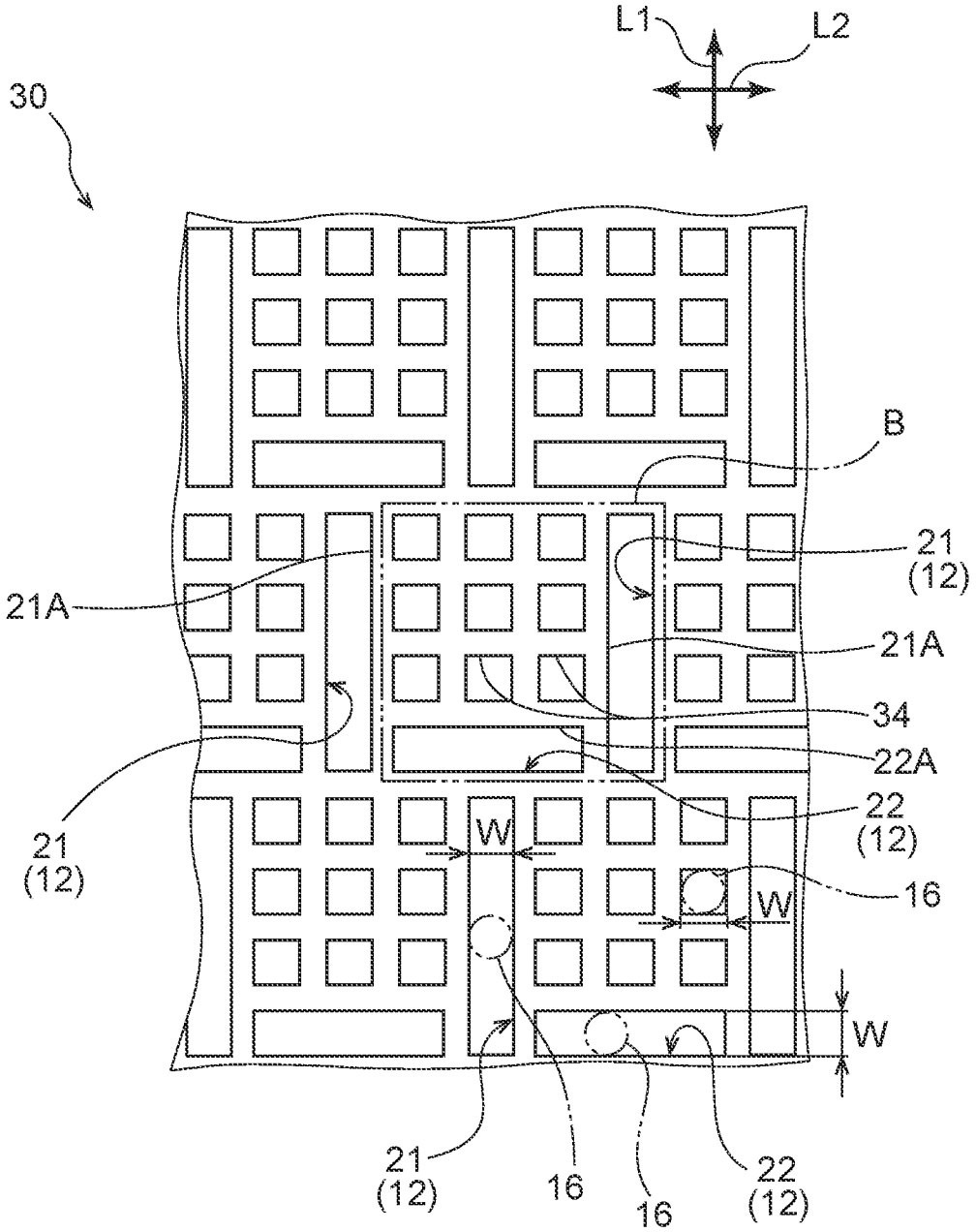
FIG. 3 is an enlarged plan view illustrating a sieve according to a third exemplary embodiment.

In a sieve 30 according to an exemplary embodiment illustrated in FIG. 3, for example, one first elongated hole 21, one second elongated hole 22, and nine short holes 34 are arranged in each unit block B. The second elongated hole 22 is arranged at one first length direction L1 side end portion, for example a lower end in FIG. 3, of each unit block B.

Each short hole 34 has a square shape, this being an example of a polygonal shape, plan view profile. For example, three rows of short holes 34 are arranged on one width direction side (the other first length direction L1 side) of the second elongated hole 22. Three of the short holes 34 are arranged in each row. An edge width W of the short holes 34 and a width W of the first elongated holes 21 are set slightly larger than the diameter of the particles 16 so as to allow the particles 16 for classification to pass through.

Thus, a configuration is also possible in which an extension line running along the first length direction L1 does not intersect the second length direction L2 center point of the corresponding second elongated hole 22, and an extension line running along the second length direction L2 does not intersect the first length direction L1 center point of the corresponding first elongated hole 21.

Other portions are similar to those in the first exemplary embodiment, and so the same reference numerals are appended to these portions in the drawings, and explanation thereof is omitted.

Fourth Exemplary Embodiment

Figure 4:
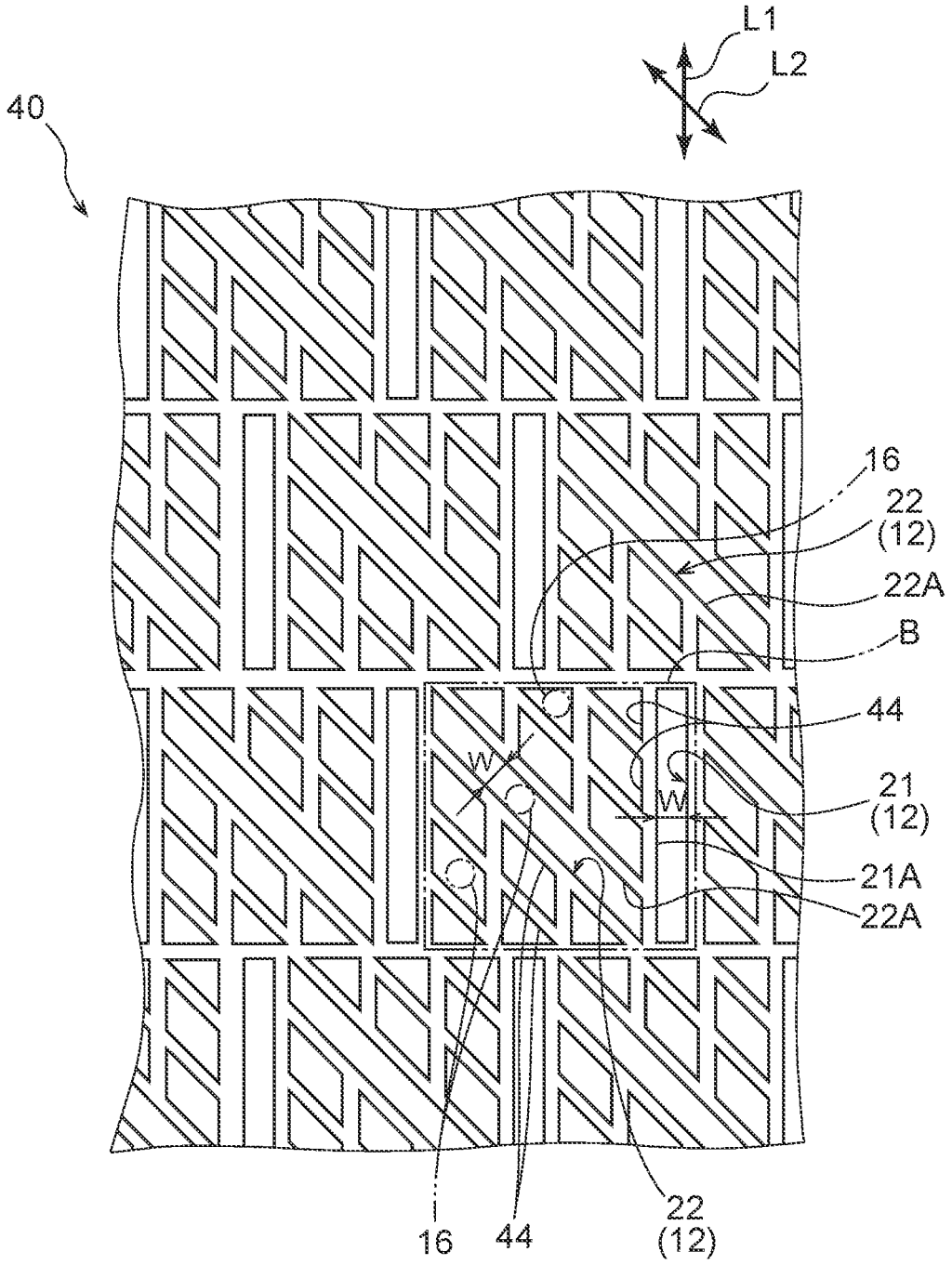
FIG. 4 is an enlarged plan view illustrating a sieve according to a fourth exemplary embodiment.

In a sieve 40 according to an exemplary embodiment illustrated in FIG. 4, for example, one first elongated hole 21, one second elongated hole 22, and twelve short holes 44 are arranged in each unit block B. For example, the second elongated hole 22 is formed in a parallelogram shape in each unit block B, and is at an angle with respect to the first length direction L1. For example, the second elongated hole 22 extends from the upper left of each unit block B toward a lower end of the first elongated hole 21 positioned at the lower right of the unit block B.

Each short hole 44 has either a triangular shape or a parallelogram shape plan view profile, these being examples of polygonal shapes, so as to fit into the rectangular or square shape of the unit block B. For example, three rows of short holes 44 are arranged on either width direction side of each second elongated hole 22. The number of short holes 44 in each row differs according to the location. Three short holes 44 are arranged in the rows nearest to the second elongated hole 22. Two short holes 44 are arranged in the rows next closest to the second elongated hole 22. One short hole 44 is arranged in the rows furthest from the second elongated hole 22.

The shapes of the short holes 44 are not uniform, but are shapes just large enough to allow the particles 16 for classification to pass through. As an example, the diameter of an inscribed circle of each triangular short hole 44 is set slightly larger than the diameter of the particles 16 so as to allow the particles 16 for classification to pass through. The width of each parallelogram-shaped short hole 44 is set slightly larger than the diameter of the particles 16 so as to allow the particles 16 for classification to pass through.

Other portions are similar to those in the first exemplary embodiment, and so the same reference numerals are appended to these portions in the drawings, and explanation thereof is omitted.

Other Exemplary Embodiments

Examples of exemplary embodiments of the present invention have been given above. However, exemplary embodiments of the present invention are not limited to the above, and obviously various other modifications may be implemented within a range not departing from the spirit of the present invention.

For example, the respective exemplary embodiments may be combined as appropriate. Moreover, there is no limitation to a regular arrangement of the unit blocks B, and the unit blocks B may be randomly arranged. In the sieves 10, 20, 30, 40, adjacent unit blocks B may include regions that are in-phase with each other. "Unit blocks B in-phase with each other" refers to the second length direction L2 positions of unit blocks B being aligned such that plural first elongated holes 21 form a row along the first length direction L1.

Although one or more rows of short holes 14, 24, 34, 44 are arranged parallel to the second length direction L2, there is no limitation thereto, and the short holes 14, 24, 34, 44 may be arranged at an angle with respect to the second length direction L2. Moreover, the short holes 14, 24, 34, 44 may be arranged in a staggered shape (alternately in the up-down and left-right directions), or may be arranged randomly.

Although circular shapes, elliptical shapes, square shapes, triangular shapes, and parallelogram shapes have been given as examples of the shapes of the short holes 14, 24, 34, 44, there is no limitation thereto, and the short holes 14, 24, 34, 44 may have oval shapes, trapezoidal shapes, or the like. Alternatively, a combination of short holes in various shapes may be employed.

The entire disclosure of Japanese Patent Application No. 2017-38268 filed Mar. 1, 2017 is incorporated by reference in this specification.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A sieve comprising:

unit blocks that are arrayed along an up-down direction and a left-right direction, each unit block including elongated holes and short holes that are shorter than the elongated holes, wherein:

in each of the unit blocks, the elongated holes include a first elongated hole extending along a first length direction and a second elongated hole extending along a second length direction, an extension line running along the second length direction being orthogonal to the first length direction; and a plurality of rows of the short holes, each of the rows containing a plurality of the short holes, are arranged in each of the unit blocks along respective long edges of the first elongated holes.

2. The sieve of claim 1, wherein:

an extension line running along the first length direction intersects a second length direction center point of the second elongated hole.

3. The sieve of claim 2, wherein a plan view profile of the short holes is at least one of a circular shape, an elliptical shape, or a polygonal shape.

4. The sieve of claim 1, wherein a plan view profile of the short holes is at least one of a circular shape, an elliptical shape, or a polygonal shape.

* * * * *